US007588224B2

(12) United States Patent
Bernstorf et al.

(10) Patent No.: US 7,588,224 B2
(45) Date of Patent: Sep. 15, 2009

(54) UNIVERSAL CLAMP

(75) Inventors: Robert A. Bernstorf, Wadsworth, OH (US); Bastiaan H. Van Besouw, Strongsville, OH (US); Jeffery L. Thomas, Aiken, SC (US); Michael J. Lee, Aiken, SC (US); Matthew M. Bates, Lexington, SC (US); Gualberto J. Sanchez, Aiken, SC (US); Carl R. Tamm, Trussville, AL (US); Richard J. Hesson, Bowmanville (CA)

(73) Assignee: Hubbell Incorporated, Orange, CT (US)

( * ) Notice: Subject to any disclaimer, the term of this patent is extended or adjusted under 35 U.S.C. 154(b) by 204 days.

(21) Appl. No.: 11/790,690

(22) Filed: Apr. 26, 2007

(65) Prior Publication Data

US 2008/0265119 A1 Oct. 30, 2008

(51) Int. Cl.
*A47B 96/06* (2006.01)

(52) U.S. Cl. ..... 248/229.22; 248/229.24; 248/229.25

(58) Field of Classification Search ..... 248/229.22, 248/229.24, 229.25, 229.12, 229.14, 229.15, 248/316.4, 316.6, 230.3, 230.5, 230.6, 231.41, 248/231.61, 231.71, 244, 45, 268; 269/244, 269/45, 268, 249, 250, 246, 252, 253; 174/40 TD, 174/45 TD, 40 CC; 285/420
See application file for complete search history.

(56) References Cited

U.S. PATENT DOCUMENTS 526,753 A * 10/1894 Siller ..... 269/84
1,315,509 A * 9/1919 Joyce ..... 269/146
1,538,500 A * 5/1925 Aubard ..... 269/98
1,783,594 A * 12/1930 Woods ..... 269/142
1,974,628 A * 9/1934 Donald ..... 248/228.3
2,553,802 A * 5/1951 Woods ..... 269/142
3,026,368 A 3/1962 Lindsey
3,146,982 A * 9/1964 Budnick ..... 248/68.1
3,437,742 A 4/1969 Lindsey
3,437,743 A 4/1969 Lindsey
3,495,795 A * 2/1970 Brown ..... 248/230.5
3,553,351 A 1/1971 Lindsey
3,556,506 A 1/1971 Welker
3,601,295 A * 8/1971 Lowe ..... 224/42.38
3,626,497 A * 12/1971 Lambert et al. ..... 251/8
3,836,102 A 9/1974 Hall
4,178,470 A 12/1979 Jean et al.
4,448,406 A * 5/1984 Hallberg et al. ..... 269/224
4,579,306 A 4/1986 Kellett et al.
4,727,224 A 2/1988 Kellett et al.
4,826,113 A * 5/1989 Winters ..... 248/72

(Continued)

*Primary Examiner*—A. Joseph Wujciak, III
(74) *Attorney, Agent, or Firm*—Jenae C. Gureff; Mark S. Bicks; Alfred N. Goodman

(57) ABSTRACT

A universal clamp assembly having a support fitting with arms and a threaded bolt mounted to the arms allowing rotation about a longitudinal axis of the bolt. The bolt is retained against axial movement along the longitudinal axis. A clamp member is rotatably mounted on the bolt between the arms for rotation of the clamp member relative to the support fitting about the longitudinal axis. The clamp member is restrained against axial movement relative to the support fitting and the bolt along the longitudinal axis. The clamp includes a guide opening through which the bolt extends. A keeper is threadedly mounted on the bolt and partially received in the guide opening. The keeper slides in the guide opening along the longitudinal axis and is restrained against rotation about the longitudinal axis of the bolt relative to the clamp member. The keeper is rotatable about the longitudinal axis concurrently with the clamp member.

14 Claims, 7 Drawing Sheets

U.S. PATENT DOCUMENTS 5,064,971 A 11/1991 Bogdanow
5,435,507 A 7/1995 Murphy
5,586,373 A * 12/1996 Eby et al. ..... 24/525
5,765,902 A * 6/1998 Love ..... 296/100.01
5,837,943 A 11/1998 Kellett
6,286,797 B1 * 9/2001 Thaxton ..... 248/229.14
6,494,642 B1 * 12/2002 Daly ..... 405/36
6,619,644 B1 * 9/2003 Liou ..... 269/185
6,913,234 B2 * 7/2005 Weiss ..... 248/231.71

* cited by examiner

UNIVERSAL CLAMP

FIELD OF THE INVENTION

The present invention relates to a universal clamp assembly for receiving electrical conductors of various diameters without interchanging parts. More particularly, the invention relates to a clamp assembly having a support fitting with two arms, a threaded bolt mounted to the arms and a clamp member rotatably mounted on the bolt allowing rotation of the clamp member. A keeper is threadedly mounted on the bolt and partially received in a guide opening of the clamp. The keeper moves back and forth along the track of the bolt towards and away from a saddle portion of the clamp member. The bolt allows the saddle and keeper to swivel about the axis of the bolt for horizontal and vertical mounting of the clamp assembly.

BACKGROUND OF THE INVENTION

Conventional clamp and insulator assemblies are unable to accommodate a variety of sizes without interchanging parts. Common mechanical clamps used in conjunction with insulators as a multi-piece system present a number of problems, including wasting time and material. Another issue is the difficulty of performing line maintenance with separate insulators and clamps because the use of removable bolts and washers increases the chances of a lineman dropping parts during installation or losing parts during storage and handling operations.

The requirement for different insulators for horizontal and vertical mountings leads to an increase in the number and types of clamps. Sometimes as many as three different clamp sizes may be required for securing conductors of different diameters. Typical insulator and clamp arrangements require repairs that replace both the clamps and the insulator. Using a multi-piece clamp and insulator assembly, a lineman must be extremely cautious to avoid dangerous consequences.

Accordingly, a need exists for providing a universal clamp mounted on a support fitting atop an insulator that can swivel about the longitudinal axis of a bolt without passing completely through the support fitting to accommodate horizontal and vertical mounting. Further, a need exists for providing a universal clamp that can accommodate more than one size conductor between a clamp member and a keeper without changing parts.

SUMMARY OF THE INVENTION

Accordingly, an object of the present invention is to provide a universal clamp assembly having a threaded keeper mounted on a bolt for moving back and forth with bolt rotation towards a clamp member having two outwardly facing ends and a saddle disposed therebetween.

Another object is to provide a universal clamp assembly for securing a conductor between a keeper and the saddle section of a clamp member such that conductors of various diameters can be accommodated.

A further object is to provide a universal clamp assembly having the clamp member mounted on a support fitting and a threaded bolt mounted to first and second arms of the support fitting allowing rotation about a longitudinal axis of the bolt and retaining the bolt against axial movement along the longitudinal axis.

Still another object is to provide a universal clamp with a bolt allowing the clamp to swivel about the axis of the bolt without passing completely through the support fitting.

Accordingly, yet another object is to provide a universal clamp for both horizontal and vertical mounting.

Yet another object is to provide a universal clamp having a clamp member with the two outwardly flaring and curved ends that face away from the conductor to minimize corrosion and prevent abrasion of the conductor.

The foregoing objects are basically attained by providing a clamp assembly having a support fitting with first and second arms and a threaded bolt mounted to the arms for rotation about a longitudinal axis of the bolt. The bolt is retained against axial movement along the longitudinal axis. A clamp member is rotatably mounted on the bolt between the arms for rotation of the clamp member relative to the support fitting about the longitudinal axis. The clamp member is restrained against axial movement relative to the support fitting and the bolt along the longitudinal axis. The clamp member includes a guide opening through which the bolt extends. A keeper is threadedly mounted on the bolt and partially received in the guide opening. The keeper slides in the guide opening along the longitudinal axis and is restrained against rotation about the longitudinal axis relative to the clamp member. The keeper is rotatable along the longitudinal axis concurrently with the clamp member.

As used in this application, the terms "top", "bottom", and "side" are intended to facilitate the description of the invention, and are not intended to limit the present invention to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
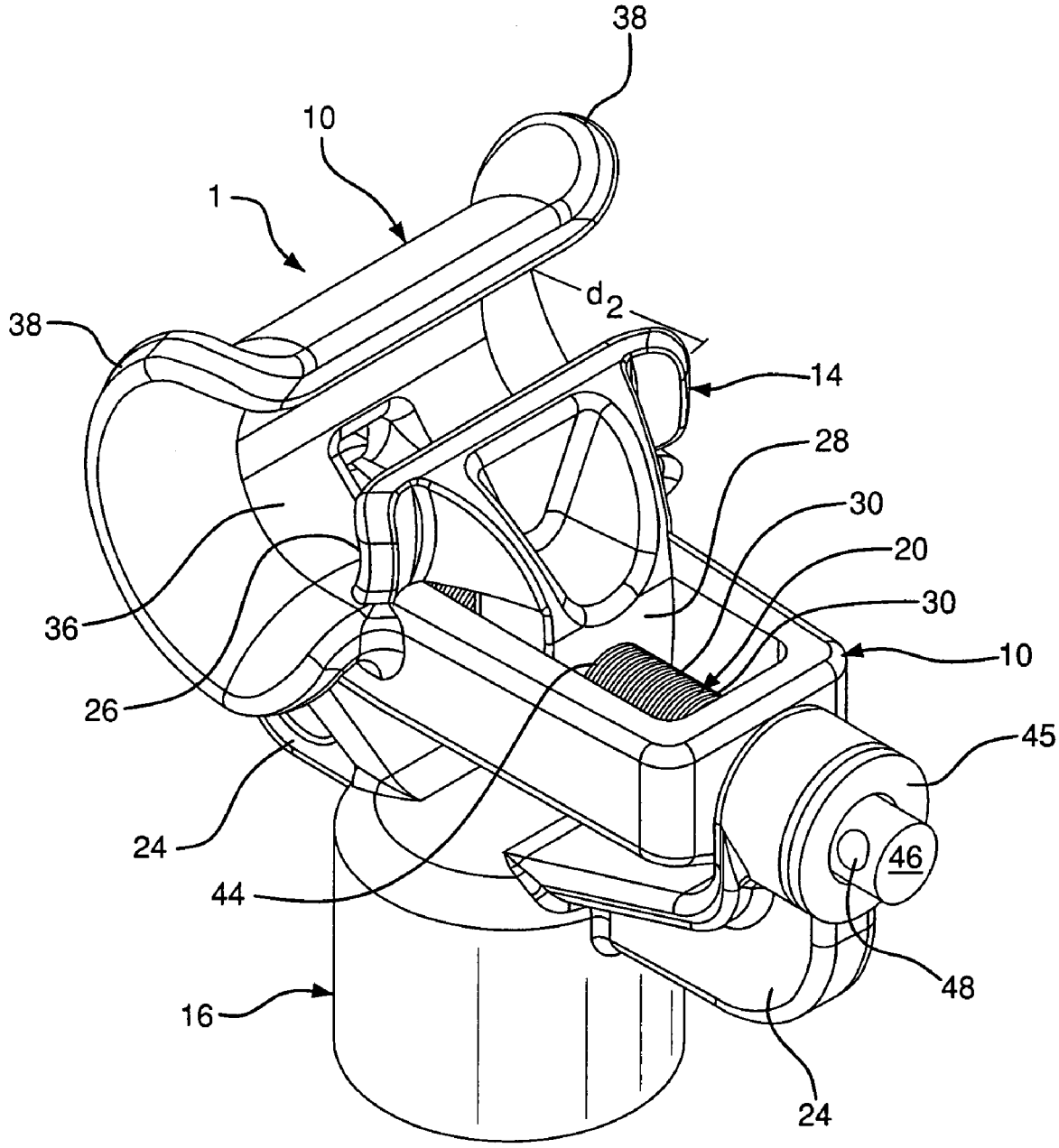
FIG. 1 is a front perspective view of the universal clamp according to an embodiment of the present invention.
Figure 2:
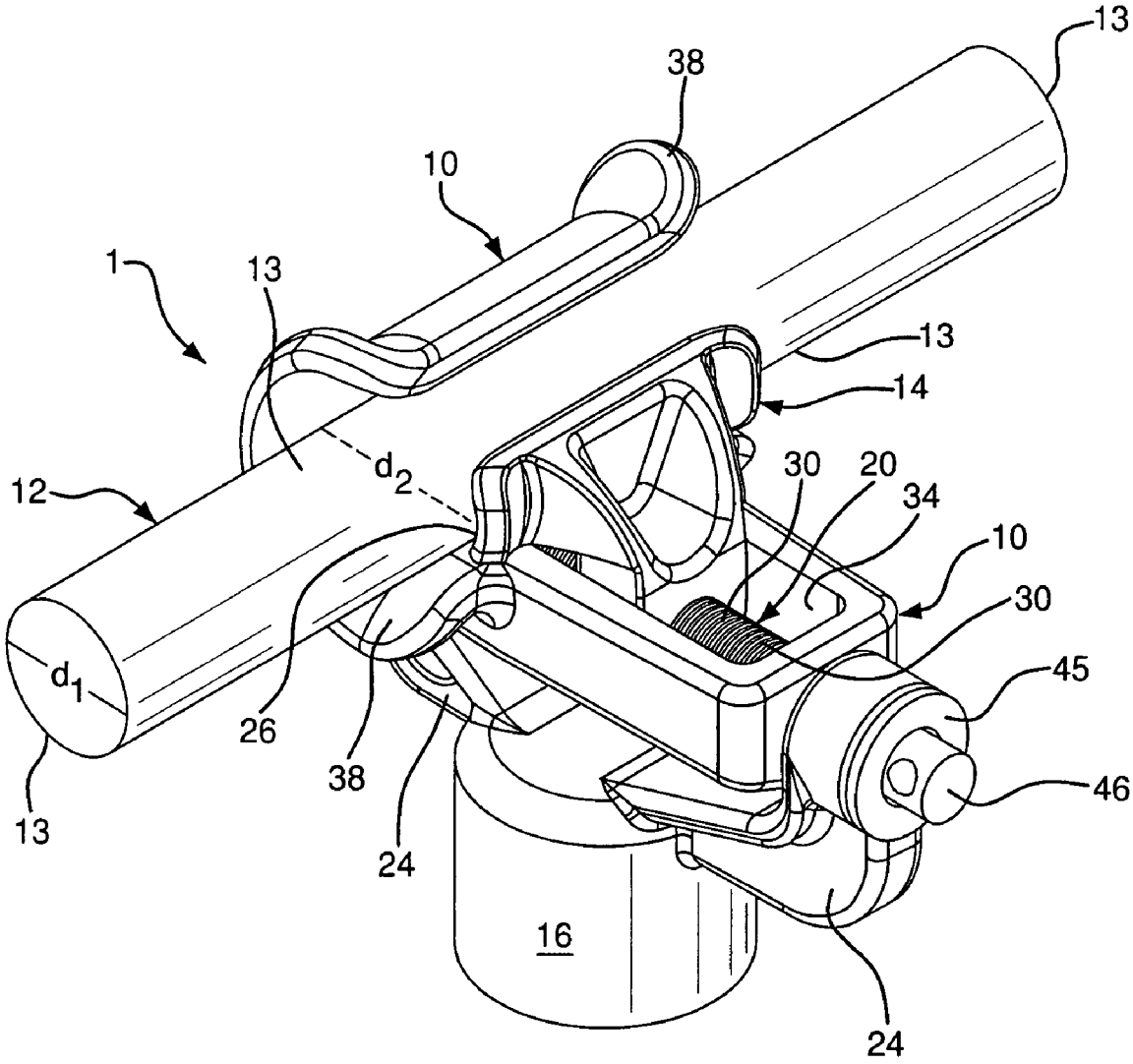
FIG. 2 is a front perspective view of the universal clamp according to FIG. 1 with an electrical conductor received in the clamp member and the keeper disposed in the clamping position.
Figure 3:
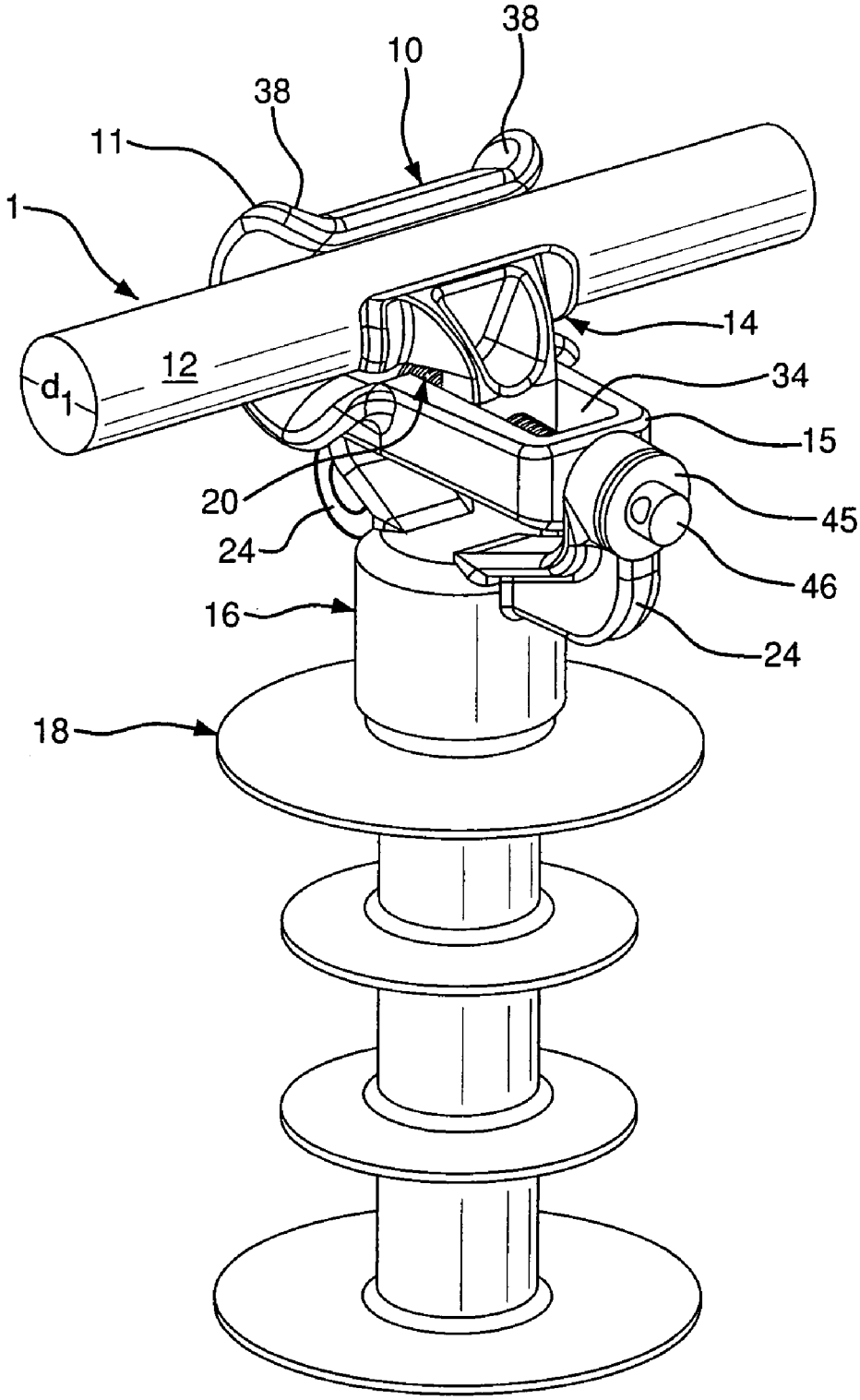
FIG. 3 is a front perspective view of the universal clamp according to FIGS. 1 and 2 with an electrical conductor received in the clamp member and the keeper disposed in the clamping position with a full view of the support fitting atop an insulator.

As seen in FIGS. 1-3, a universal clamp assembly 1 includes a support fitting 16 with first and second arms 24 and a threaded bolt 20 mounted to the arms 24 for rotation about a longitudinal axis of the bolt 20. The bolt 20 is retained against axial movement along the longitudinal axis. The clamp assembly 1 further includes a clamp member 10 rotatably mounted on the bolt 20 between the arms 24 for allowing rotation of the clamp member 10 relative to the support fitting 16 about the longitudinal axis. The clamp member 10 is restrained against axial movement relative to the support fitting 16 and the bolt 20 along the longitudinal axis. The clamp member 10 includes a guide opening 34 through which the bolt 20 extends. A keeper 14 is threadedly mounted on the bolt 20 and partially received in the guide opening 34. The keeper 14 slides in the guide opening 34 along the longitudinal axis and is restrained against rotation about the longitudinal axis relative to the clamp member 10. The keeper 14 is rotatable along the longitudinal axis concurrently with the clamp member 10.

The support fitting 16 is disposed atop an insulator 18 and crimped onto one of the insulator 18 ends. Both the support fitting 16 and the insulator 18 are of a conventional design. First and second arms 24 of the support fitting 16 branch out from the upper portion of the insulator 18 and project towards the outer first end 11 and second end 15 of the clamp member 10.

The universal feature of the clamp assembly 1 to contain a variety of electrical conductors 12 having multiple diameters d1 is captured by the variable distance d2 between the inside surface 26 of the keeper 14 and the saddle 36 of the clamp member 10. Both surfaces are concavely curved and oriented against the exterior walls 13 of the conductor 12. The back and forth movement traveled by the keeper 14 between the saddle 36 and second end 15 is controlled by rotating the bolt 20.

Rotating the bolt 20 increases, or decreases, the distance between the axially fixed position clamp member 10 and the adjustable position keeper 14. As the keeper 14 moves along the longitudinal axis of the bolt 20 within the guide opening 34, the distance between the keeper 14 and the clamp member 10 is adjusted to accommodate the electrical conductor 12 therebetween.

Distance d2 is directly proportional to the diameter d1 of the conductor 12 received therebetween. For example, as the size of the conductor 12 diameter d1 increases so too does the distance d2 between the keeper 14 and the saddle 36. The distance d2 is equivalent to the diameter of the conductor 12 or distance d1.

The clamp member 10 is substantially J-shaped having a first longitudinal end 11 and a substantially rectangular-shaped second longitudinal end 15 adjacent to first and second arms 24 with the guide opening 34 therebetween. The clamp member 10 is further defined by a concavely curved saddle 36 disposed at the first end 11 and sandwiched between contoured ends 38. The contoured ends 38 flare outwardly and are curved to face away from the conductor 12 to provide secure clamping of the conductor 12, while simultaneously preventing and eliminating any abrasion of the conductor 12.

The clamp member 10 is restrained against axial movement along the bolt 20 by arms 24, with the bolt extending between the first end 11 and second end 15 and through the guide opening 34 of the clamp. The guide opening 34 is the passageway for the keeper 14 along the longitudinal axis of the threaded bolt 20. Guide opening 34 receives both the threaded bolt 20 and keeper 14.

Figure 6:
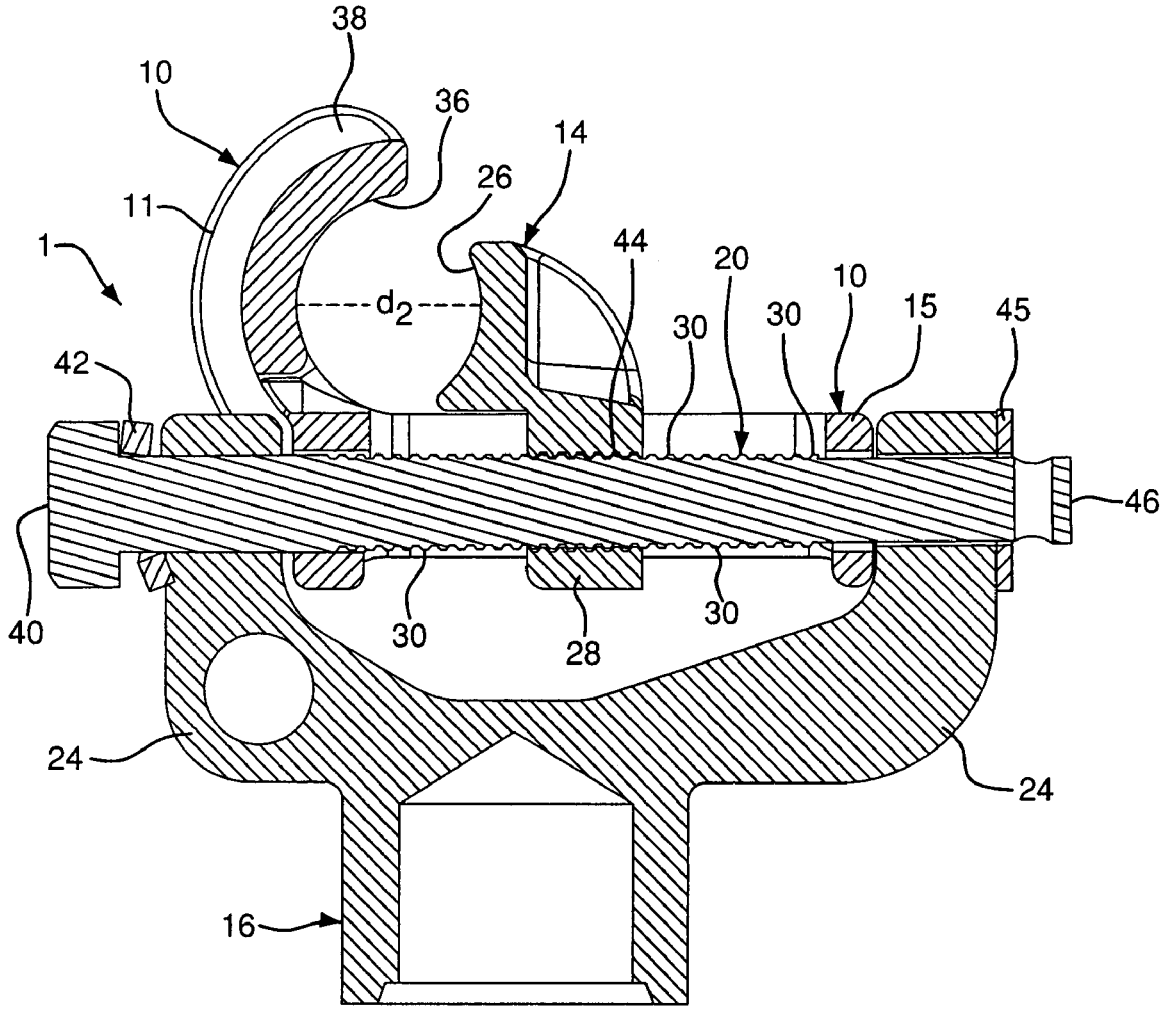
FIG. 6 is a side elevational view in cross section of the universal clamp taken along line 6-6 of FIG. 1.

Turning now to FIG. 6, the size of the keeper 14 is substantially smaller than that of the clamp member 10. The inside surface 26 of the keeper 14 is concavely curved for fitting smoothly against the conductor 12 at the side of the conductor opposite the saddle 36. The keeper 14 includes a rectangular bottom end 28 having a threaded bore 44 receiving the threads 30 of the bolt 20. The bottom end 28 is received in the guide opening 34 such that its sides prevent relative rotation of the clamp member 10 and the keeper 14 about the longitudinal axis of the bolt 20. This restriction of rotation causes the keeper 14 to move along the longitudinal axis upon rotation of the bolt 20, specifically along the threads 30 of the bolt 20 towards the saddle 36 for securing the conductor 12.

Together, the connection between the support fitting 16 and the threaded bolt 20 secures the electrical conductor 12 to the clamp assembly 1 and retains the axial position of the clamp member 10 until the keeper 14 moves away from the clamp member 10. The arrangement of the bolt 20 enables the clamp member 10 to swivel along the longitudinal axis of the bolt 20 without passing completely through the support fitting 16. (This relationship is discussed in further detail below.).

Best seen in FIG. 6, the bolt 20 extends entirely through both arms 24 of the support fitting 16. The end of the bolt 20 closest to the saddle 36 is defined by a hex head 40 adjacent to a washer 42 surrounding the body of the bolt 20. Optionally, a bolt with an eye can be disposed adjacent to the washer 42 for use with a hot-stick tool. The washer 42 prevents the bolt 20 from moving too far from the first end 11 and jamming the hex head 40 into an arm 24 of the support fitting 16. This way, the threads 30 of the bolt 20 are always engaged with the keeper 14 while having enough space between the guide opening 34 to allow for movement of the keeper 14 relative to the diameter of the conductor 12.

Figure 7:
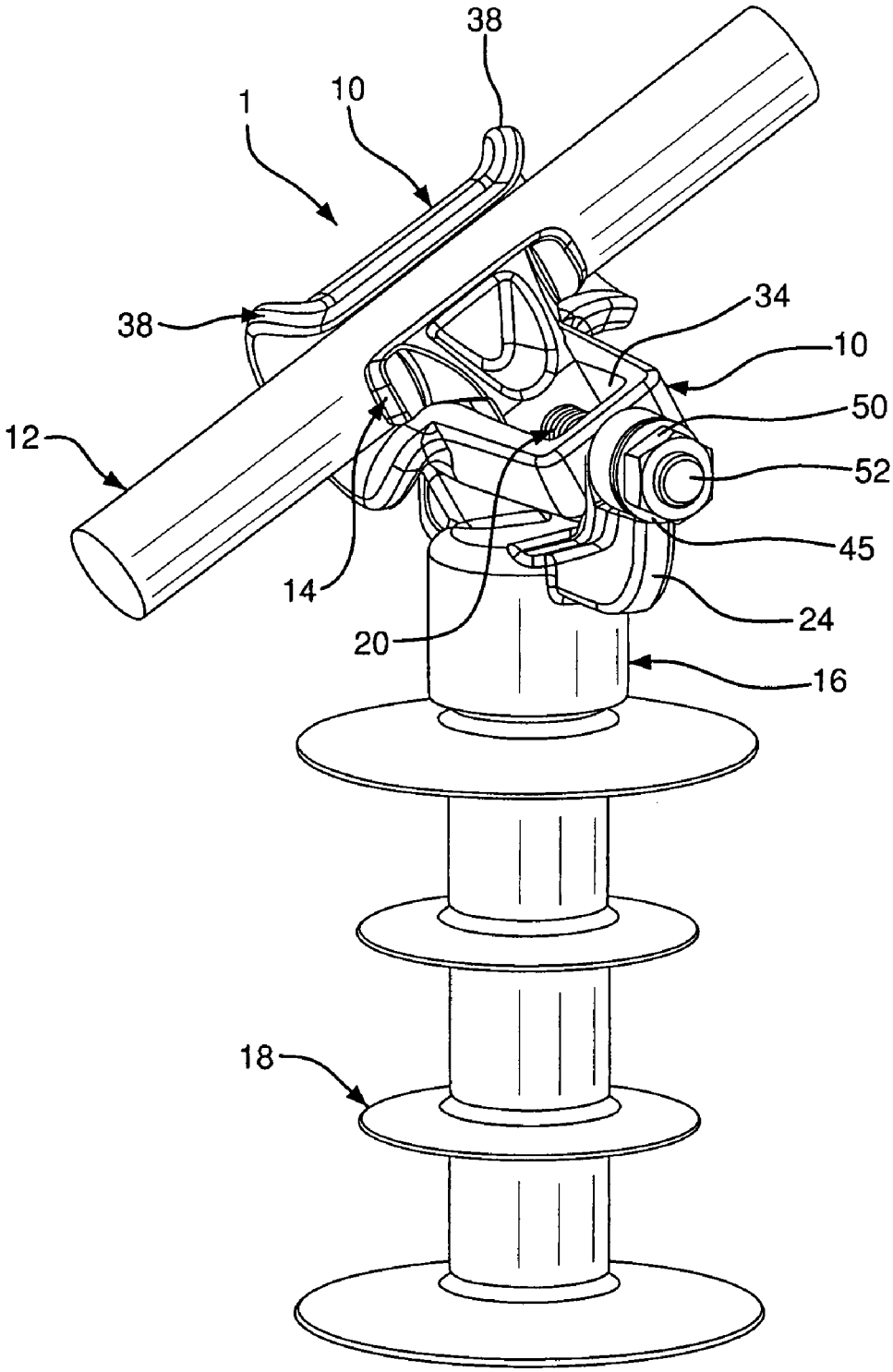
FIG. 7 is a front perspective view of the universal clamp according to FIG. 1 illustrating the bolt secured by a nut adjacent to the second washer.

The opposite end of the bolt 20 is secured with a second washer 45 and a pin 46 to prevent the bolt 20 from separating from the assembly. This configuration ensures that the bolt 20 is fixed against axial movement, but can be rotated with a tool inserted into an opening 48 in the pin 46. Additionally, turning to FIG. 7, the bolt 20 could be secured with a nut 50 adjacent to the second washer 45. The nut 50 is rotated over the end 52 of the bolt 20. Specifically, a castle nut or a jam nut would be locked with a pin. Jam nuts are preferred because they are thinner than conventional nuts and consequently occupy less space.

Figure 4:
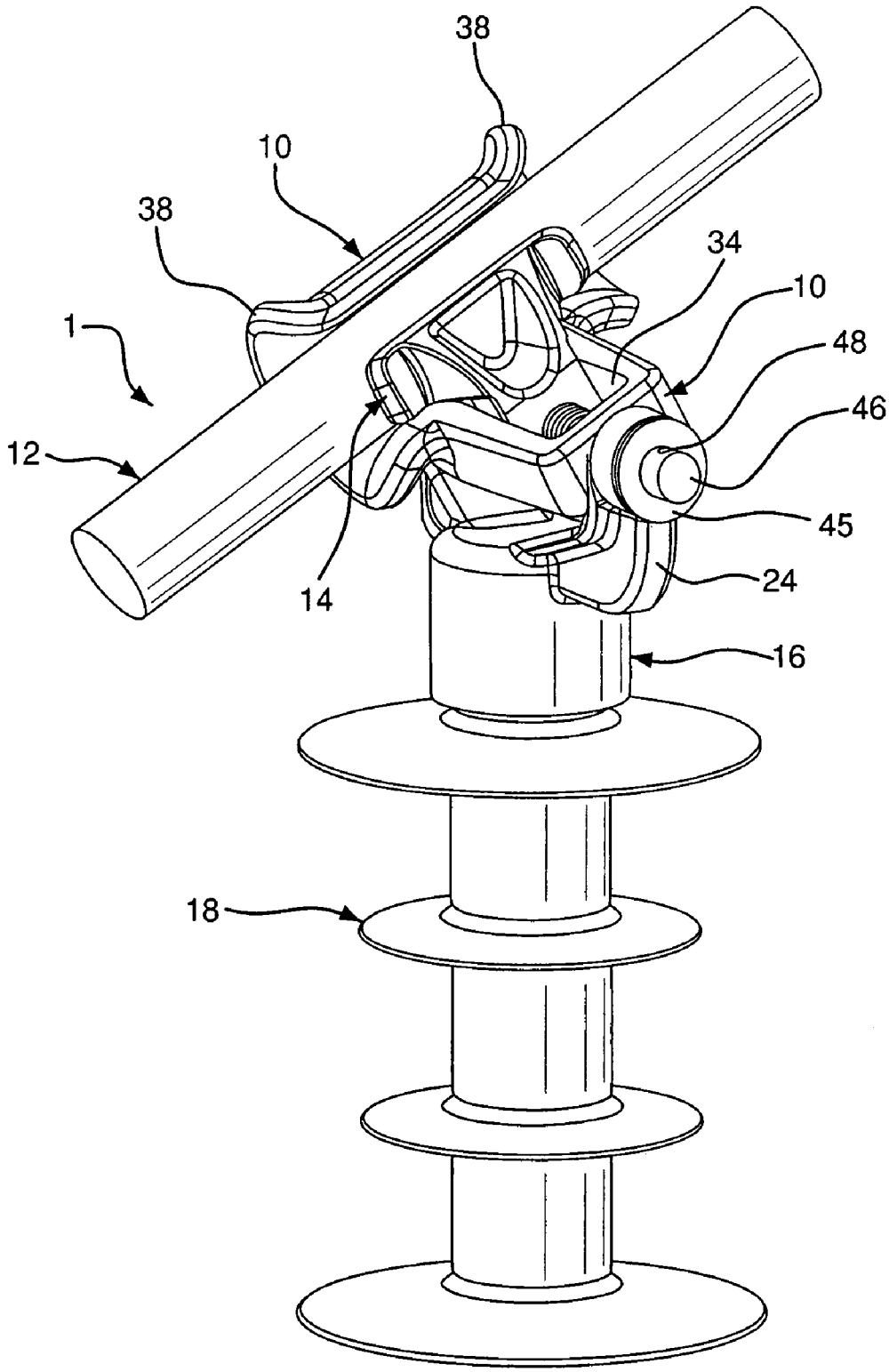
FIG. 4 is a front perspective view of the universal clamp according to FIGS. 1-3 with the clamp member swiveled away from the horizontal, while clamping the conductor between the saddle and the keeper.
Figure 5:
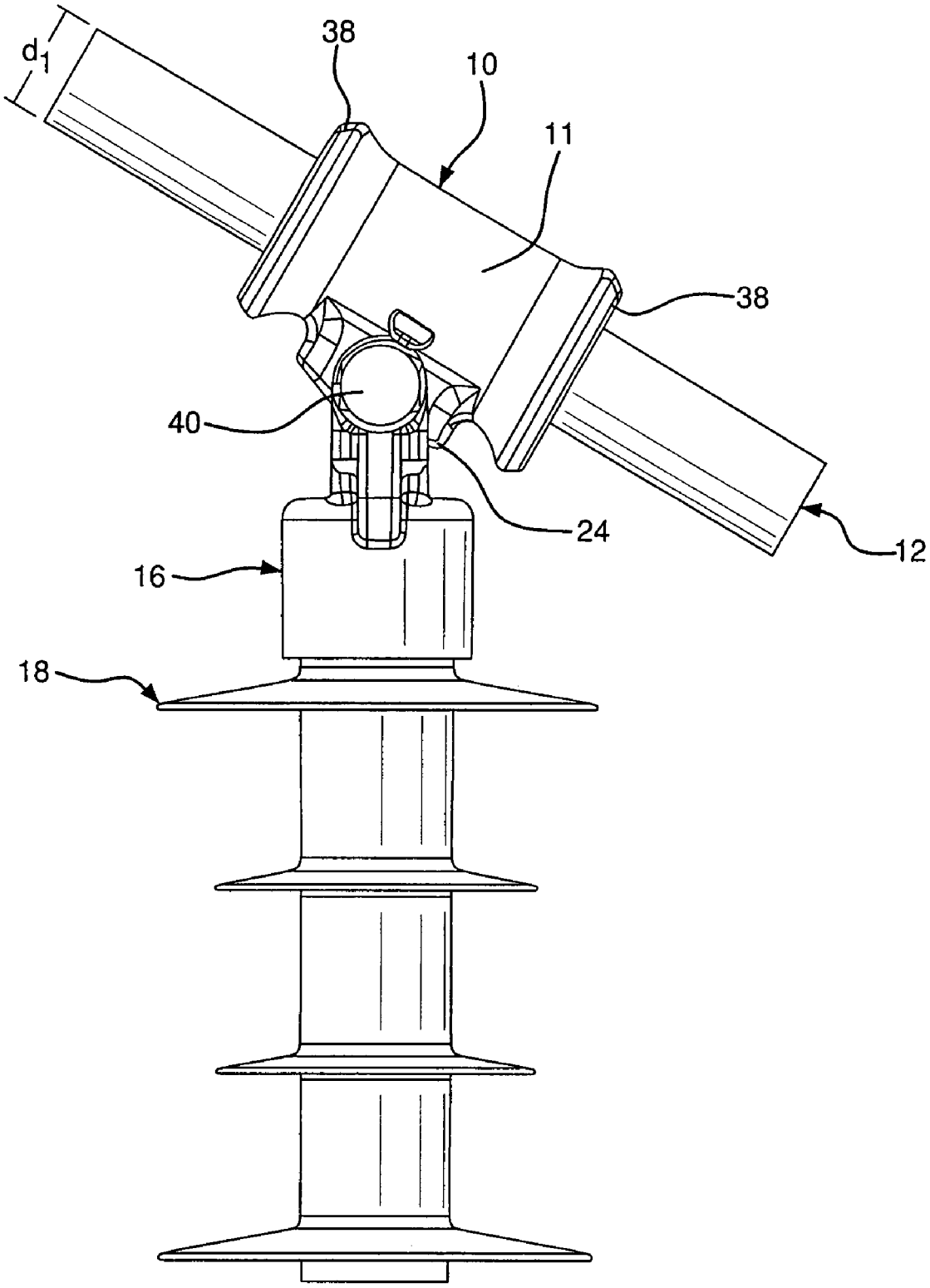
FIG. 5 is a side elevational view of the universal clamp of FIG. 4 with the clamp member, keeper, and electrical conductor swiveled away from the horizontal axis and towards the vertical axis.

As seen in FIGS. 4 and 5, the unique shape of the clamp member 10 and orientation of the clamp member 10 and keeper 14 to the bolt 20 atop the support fitting 16 allows for horizontal as well as vertical mounting of the clamp member 10. The orientation of the saddle 36 and its depth allows the clamp member 10 to restrain the conductor 12 when the clamp member 10 is horizontally or vertically attached to the end-fitting 16. This adjustability is advantageous because the clamp member 10 is universally adaptable to accommodate conductors 12 of various diameters d1 as well as conductors 12 oriented at various angles with respect to the longitudinal axis of the insulator 18. By rotating the clamp member 10 vertically 90° and swiveling about the bolt 20, the conductor 12 will be vertically mounted, as seen in FIGS. 5 and 6. This alignment ensures the conductor 12 is retained between the saddle 36 and first end 11, securely between the clamp member 10 and the keeper 14.

In this manner, it is possible for the clamp member 10 to pivot relative to the end fitting 16 without passing entirely through the distance between the top of the end fitting 16 and the bottom of the clamp member 10. The clamp member 10 shape prevents a total 360° revolution of the clamp member 10 and keeper 14 with the conductor 12 wedged therebetween.

While a particular embodiment has been chosen to illustrate the invention, it will be understood by those skilled in the art that various changes and modifications can be made therein without departing from the scope of the invention as defined in the appended claims.

What is claimed is:

1. A clamp assembly for receiving electrical conductors of various diameters without interchanging parts, comprising:

a supporting fitting with first and second arms extending along axes thereof;

a threaded bolt mounted to said arms for rotating of said bolt about a longitudinal axis of said bolt and retaining said bolt against axial movement along said longitudinal axis;

a clamp member mounted on said bolt and between the arms, said clamp member being rotatable in different orientations about said longitudinal axis relative to said support fitting and said arms, said clamp member being restrained against axial movement relative to said support fitting and said bolt along said longitudinal axis, said clamp having a guide opening through which said bolt extends; and a keeper threadedly mounted on said bolt and partially received in said guide opening, sliding in said guide opening along said longitudinal axis and being restrained against rotation about said longitudinal axis relative to said clamp, said keeper being rotatable about said longitudinal axis concurrently with said clamp.

2. The clamp assembly according to claim 1 wherein said clamp member includes first and second longitudinal ends with a saddle at said first end and said guide opening extends from said first end to said second end.

3. The clamp assembly according to claim 2 wherein said clamp member is rotatable between horizontal and vertical orientations about said bolt.

4. The clamp assembly according to claim 2 wherein said saddle includes outwardly flaring end sections that are curved away from an electrical conductor.

5. The clamp assembly according to claim 1 wherein said clamp member has a saddle at a first end thereof; and said keeper has a curved surface disposed opposite a said saddle.

6. The clamp assembly according to claim 1 wherein said keeper includes a bore threadedly receiving said bolt.

7. The clamp assembly according to claim 6 wherein said bolt is received by said bore for moving said keeper along said guide opening.

8. The clamp assembly according to claim 1 wherein a washer is mounted onto said bolt for axially securing said bolt to one of said arms.

9. The clamp assembly according to claim 1 wherein said support fitting is mounted on an insulator.

10. A clamp assembly for receiving electrical conductors of various diameters without interchanging parts, comprising:

a support fitting with first and second arms extending along axes thereof and mounted on an insulator;

a threaded bolt mounted on said arms allowing rotation of said bolt about a longitudinal axis of said bolt and retaining said bolt against axial movement along said longitudinal axis;

a clamp member having first and second longitudinal ends with a saddle at said first end, said clamp member mounted on said bolt between said arms, said clamp member being rotatable relative to said support fitting and said arms about said longitudinal, axis between horizontal and vertical orientations and being restrained against axial movement relative to said support fitting and said bolt along said longitudinal axis, said clamp member having a guide opening extending from said first end to said second end through which said bolt extends; and a keeper threadedly mounted on said bolt having a bore threadedly receiving said bolt for moving said keeper towards and away from said saddle and a curved surface disposed opposite said saddle, said keeper partially received in said guide opening to slide in said guide opening along said longitudinal axis and to be restrained against rotation about said longitudinal axis relative to said clamp, said keeper being rotatable about said longitudinal axis concurrently with said clamp member.

11. The clamp assembly according to claim 10 wherein a washer and a pin are mounted onto said bolt for axially securing said bolt to one of said arms.

12. The clamp assembly according to claim 10 wherein said saddle includes outwardly flaring end sections that are curved away from an electrical conductor.

13. The clamp assembly according to claim 10 wherein each of said arms is disposed adjacent to said bolt on opposite ends of said clamp member.

14. The clamp assembly according to claim 10 wherein a nut is mounted onto said bolt for axially securing said bolt to one of said arms.

* * * * *